US008656820B1

(12) United States Patent
Kertis, Jr. et al.

(10) Patent No.: US 8,656,820 B1
(45) Date of Patent: Feb. 25, 2014

(54) ELECTRONICALLY CONTROLLED AUTOMATIC CAM ROTOR GUN SYSTEM

(75) Inventors: Andrew J. Kertis, Jr., Norwalk, OH (US); Steven C. Genet, Tiffin, OH (US)

(73) Assignee: Ares, Inc., Port Clinton, OH (US)

( * ) Notice: Subject to any disclaimer, the term of this patent is extended or adjusted under 35 U.S.C. 154(b) by 215 days.

(21) Appl. No.: 13/213,385

(22) Filed: Aug. 19, 2011

Related U.S. Application Data

(60) Provisional application No. 61/377,104, filed on Aug. 26, 2010.

(51) Int. Cl.
*F41A 19/00* (2006.01)

(52) U.S. Cl.
USPC ..... 89/27.3; 89/28.1; 89/28.05

(58) Field of Classification Search
USPC ..... 89/27.3, 28.1, 27.11, 28.05
See application file for complete search history.

(56) References Cited

U.S. PATENT DOCUMENTS

| | | | | |
|---|---|---|---|---|
| 3,055,180 | A | | 9/1962 | Kane |
| 3,331,284 | A | | 7/1967 | Case, Jr. et al. |
| 3,648,561 | A | * | 3/1972 | Stoner ..... 89/11 |
| 3,967,530 | A | | 7/1976 | Vorgrimler et al. |
| 4,386,303 | A | | 5/1983 | Kleptz |
| 4,391,180 | A | | 7/1983 | Koine |
| 4,481,859 | A | | 11/1984 | Dix |
| 4,777,864 | A | | 10/1988 | Siech et al. |
| 4,787,291 | A | * | 11/1988 | Frohock, Jr. ..... 89/41.22 |
| 5,233,125 | A | * | 8/1993 | Bouver et al. ..... 89/36.13 |
| 7,089,844 | B2 | | 8/2006 | Becker |
| 7,131,366 | B2 | | 11/2006 | Danner et al. |
| 7,509,904 | B2 | | 3/2009 | Plumier |

* cited by examiner

*Primary Examiner* — J. Woodow Eldred
(74) *Attorney, Agent, or Firm* — MacMillan, Sobanski & Todd, LLC

(57) ABSTRACT

An automatic weapon system that closely controls the operation of a weapon, such as a cam rotor gun. The system has, among other things, an actuator for firing ammunition, a feeder for supplying ammunition to be fired, and a counter for determining the amount of fired ammunition. An actuator sensor is in communication with the actuator and a counter sensor is in communication with the counter. A controller is in communication with the actuator sensor, the counter sensor and the feeder to control the operation of the weapon.

14 Claims, 2 Drawing Sheets

ELECTRONICALLY CONTROLLED AUTOMATIC CAM ROTOR GUN SYSTEM

CROSS-REFERENCE TO RELATED APPLICATION

This relates to and claims the benefit of U.S. Provisional Patent Application No. 61/377,104, filed on Aug. 26, 2010, which is incorporated by reference.

TECHNICAL FIELD

This invention relates generally to weapons. More specifically, the invention is directed to an electronically controlled automatic cam rotor gun system.

BACKGROUND OF THE INVENTION

Some weapon systems do not adequately control firing operations of a small-caliber gun, such as a cam rotor gun. These systems require operator intervention to load and unload the weapon thereby limiting remote operations. They are unable to provide closely-controlled firing rates, controlled bursts consisting of an operator specified number of shots fired, or semi-automatic operation. Accordingly, there is a need for a gun system that closely controls firing operations. The invention provides, among other things, an electronic based remotely controlled automatic weapon that has the ability to perform all functions without operator intervention.

BRIEF SUMMARY OF THE INVENTION

The invention is an automatic weapon system that closely controls the operation of a weapon, such as a cam rotor gun. The system has, among other things, an actuator for firing ammunition, a feeder for supplying ammunition to be fired, and a counter for determining the amount of fired ammunition. An actuator sensor is in communication with the actuator and a counter sensor is in communication with the counter. A controller is in communication with the actuator sensor, the counter sensor and the feeder to control the operation of the weapon.

DETAILED DESCRIPTION OF THE INVENTION

Figure 1:
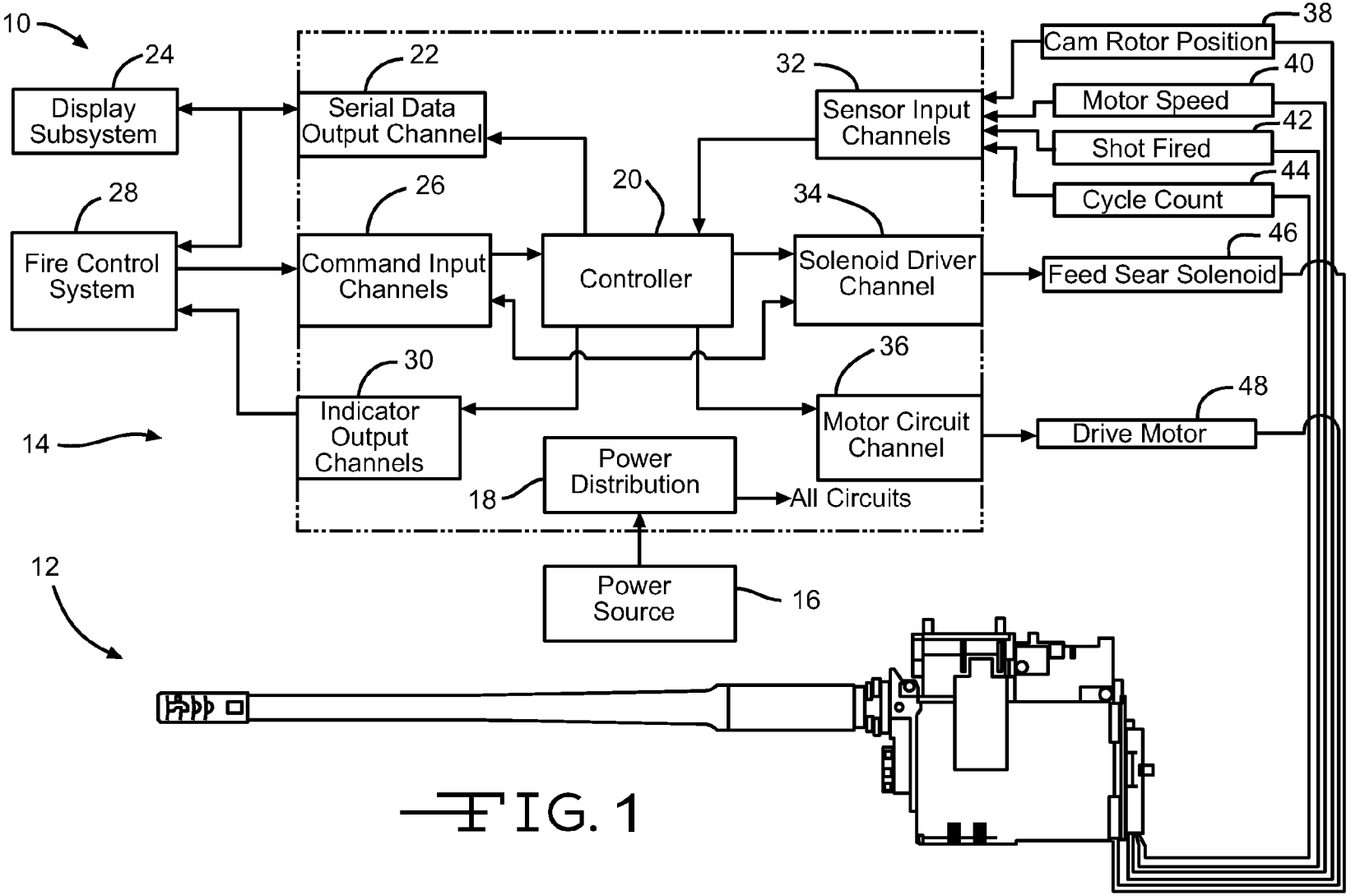
FIG. 1 is a diagram showing the electronically controlled automatic cam rotor gun system according to the invention.

Referring now to the drawings, the electronically controlled automatic cam rotor gun system of the invention is indicated generally by the reference number 10. The system 10 includes an externally-powered gun (EPG), such as a cam rotor gun 12. An example of a cam rotor gun that may be used in the system 10 is disclosed in U.S. Pat. No. 3,648,561, which is incorporated by reference. It should be understood that other externally-powered guns may be used in the system 10.

The cam rotor gun 12, such as the one disclosed in the above-identified '561 patent, includes a cylindrical rotor having a continuous spiral cam slot formed in its periphery that reciprocates a breech block to drive rounds of ammunition into a barrel to fire the round and to extract the expended cartridges after firing. A cam on the front end of the rotor controls movement of a lock that temporarily locks the breech block during the firing operation. Ejector pins on the rotor thrust an ejected cartridge sideways as the breech block is being reciprocated rearward. A cam on the rear of the rotor controls the feeding of ammunition into the path of the breech block mounted rammer. The cam rotor is driven by a small electric drive motor positioned within the rotor. A solenoid mounted at the rear of the weapon, which is operated independently from the cam rotor drive motor, controls the engagement of the feed mechanism.

Figure 2:
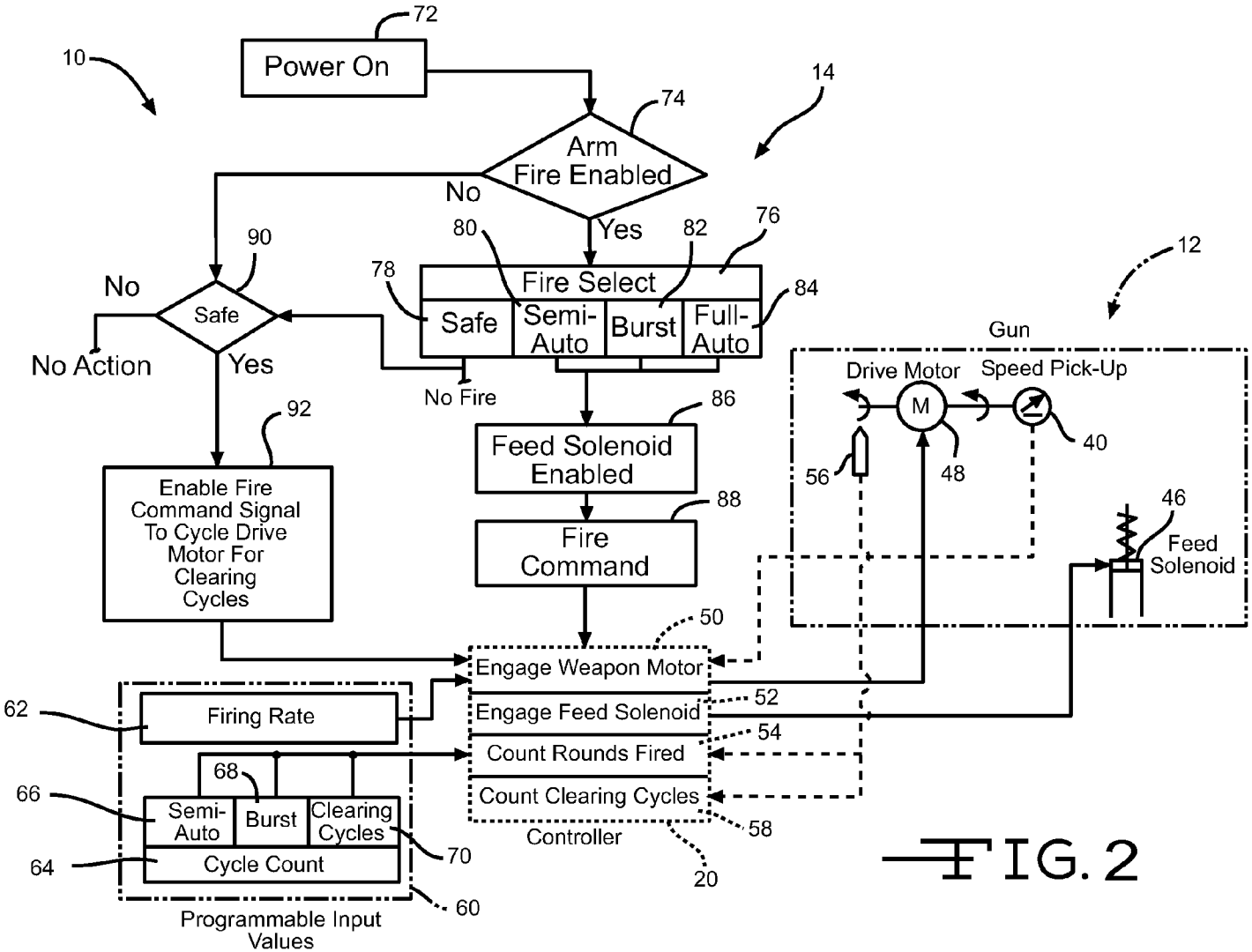
FIG. 2 is a diagram showing the electronically controlled automatic cam rotor gun system according to the invention.

Referring to FIGS. 1 and 2, the system 10 has electronic controls 14. In an embodiment, the controls 14 include a power source 16, a power distribution system 18 for providing power to all circuits, a controller 20, a serial data output channel 22, a display subsystem 24, command input channels 26, a fire control system 28, indicator output channels 30, sensor input channels 32, a solenoid driver channel 34, and a motor circuit channel 36. Sensors for cam rotor position 38, motor speed 40, shot fired 42, and cycle count 44 are in communication with the sensor input channels 32. A feed sear solenoid 46 is in communication with the solenoid driver channel 34. As described above, the feed solenoid 46 controls the engagement of the feed mechanism of the gun 12. A drive motor 48 is in communication with the motor circuit channel 36. Various types of electric drive motors may be used as the drive motor 48, such as a brushless direct current electric motor. As described above, the drive motor 48 actuates the cam rotor of the gun 12. The cam rotor position 38, motor speed 40, shot fired 42, cycle count 44 sensors, the feed solenoid 46 and the drive motor 48 are in communication with the gun 12.

Referring to FIGS. 1 and 2, the controller 20 of the system 10 is programmed to control the following: engage weapon motor 50 that is in communication with the motor speed sensor 40, such as a speed pick-up, that is in communication with the drive motor 48; engage feed solenoid 52 that is in communication with the feed solenoid 46; count rounds fired 54 that is in communication with a shot counter 56 that is communication with the shot fired sensor 42; and count clearing cycles 58 that is in communication with the cycle count sensor 44.

As shown in FIG. 2, the system 10 has programmable input values 60 for the controller 20. The values 60 include firing rate 62 in communication with engage weapon motor 50. The values 60 further include cycle count 64 for semi-automatic 66, burst 68, and clearing cycles 70 in communication with count rounds fired 54.

The operation of the system 10 will now be described. Referring to FIG. 2, the drive motor 48 and feed solenoid 46 of the gun 12 are controlled by electromotive forces that in turn are controlled by the internal programming and design of the controller 20. The programmable input values 60 for the firing rate 62 and the cycle count 64, including the semi-automatic 66 and burst 68 firing modes, and the clearing cycles 70 are utilized. Operator selections include power on 72, the system ready or arm fire enabled 74, and fire select 76, including safe 78, semi-automatic 80, burst 82, or full-automatic 84. The fire select 76 setting disables the feed solenoid 46 in the safe 78 setting and enables the feed solenoid 46 in the semi-automatic 80, burst 82, full-automatic 84 settings, as represented by feed solenoid enabled 86.

Referring to FIGS. 1 and 2, operator selection of the fire command 88 initiates sequential engagement of the drive motor 48 and the feed solenoid 46. Feedback from the gun sensors 38, 40, 42 and 44 and the programmable input values 60 of the controller 20 act to bring the drive motor 48 to operational speed to provide the selected firing rate. The feed solenoid 46 is subsequently energized to initiate the firing of the gun 12.

Still referring to FIGS. 1 and 2, upon reaching the specified number of rounds fired, the feed solenoid 46 is disengaged and the firing of the gun 12 is stopped. The controller 20 continues operation of the drive motor 48 for a predetermined number of cycles to clear the gun 12. The controller 20 has an operational mode to clear the gun 12 by operating the drive motor 48 without engaging the feed solenoid 46. The controller 20 can also be programmed for semi-automatic operation only for application in which the use of automatic weapons is prohibited.

As shown in FIG. 2, if the decision is "no" at the arm fire enabled 74 setting, the system 10 is placed in safe 90. If the decision is "no" from the safe 90 setting, then there is no action. If the decision is "yes" from the safe 90 setting, then the system 10 is placed in enable fire command signal to cycle the drive motor for clearing cycles 92, which is in communication with the engage weapon motor 50 portion of the controller 20. The safe 78 setting of the fire select 76 setting is in communication with the safe 90 setting.

The system 10 has electronic controls 14, including the controller 20, that provide a closed-loop system utilizing feedback of data to provide the means of determining the weapon state and adjusting operation in real time to maintain the firing rate and the number of shots fired as commanded by the system. The controller 20 stores the number of rounds fired and the number of non-firing gun cycles providing the means to project failure by predicting the number of shots yet to be fired. It also has the ability to predict gun cycles before an out-of-limit condition occurs or scheduled maintenance is required.

The system 10 provides many advantages and capabilities. For example, the system 10 allows for an operator selectable firing mode for single shot, limited burst, and unlimited burst firing. It also allows for manufacturer lock out of burst firing mode. Further, the shot counter 56 and the shot fired sensor 42 of the system 10 provide shot-fired data that can be processed for barrel life and life-cycle count of the gun 12. This data can be combined with real time firing rate data to be used to extend the life of the gun 12 by reducing the firing rate and modifying the firing schedule. The system 10 also allows for the utilization of sensor and performance data feedback to maintain performance regardless of variations in external influences such as the ammunition belt-pull force, temperature, or weapon installation. This data can also be utilized to adjust firing rate to limit the increase in barrel temperature from extended firing of the gun 12.

As it will be appreciated, the invention provides an electronically controlled automatic cam rotor gun system 10 that has, among other things, electronic controls 14 to closely control the operation of a cam rotor gun 12. The system 10 may be used on mobile, maritime, and stationary installations as a force protection unit.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

What is claimed is:

1. A weapon system comprising:

a cam rotor gun having an electric drive motor for firing ammunition, a feeder for supplying ammunition to be fired by the gun, and a counter for determining the amount of ammunition fired by the gun;

a drive motor sensor in communication with the drive motor, a feed solenoid in communication with the feeder, and an ammunition counter sensor in communication with the counter; and a controller in communication with the drive motor sensor, the feed solenoid, and the counter sensor, the controller having programmable input values for controlling the ammunition firing operation of the gun in safe, semi-automatic, burst and full-automatic modes of operation by signals to the drive motor sensor, the feed solenoid and the counter sensor.

2. The weapon system of claim 1, wherein the ammunition counter is a shot counter.

3. The weapon system of claim 1, wherein the actuator sensor is a motor speed sensor.

4. The weapon system of claim 1, wherein the system has sensor input channels, the actuator sensor and the counter sensor being in communication with the controller through the sensor input channels.

5. The weapon system of claim 1, wherein the system has a solenoid driver channel, the feeder being in communication with the controller through the solenoid driver channel.

6. The weapon system of claim 1, wherein the controller is programmed for engaging the actuator, engaging the feeder, counting ammunition fired, and counting ammunition clearing cycles as the gun is being cleared.

7. The weapon system of claim 1, wherein the controller has programmable input values for firing rate.

8. The weapon system of claim 1, wherein the controller has programmable input values for counting the operating cycles of the gun.

9. The weapon system of claim 1, wherein the system has a motor circuit channel, the actuator being in communication with the controller through the motor circuit channel.

10. The weapon system of claim 1, wherein the system has a fire control system in communication with the controller.

11. The weapon system of claim 10, wherein the system has command input channels, the fire control system being in communication with the controller through the command input channels.

12. The weapon system of claim 10, wherein the system has indicator output channels, the controller being in communication with the fire control system through the indicator output channels.

13. The weapon system of claim 1, wherein the system has a display subsystem.

14. The weapon system of claim 13, wherein the system has a serial data output channel, the display subsystem being in communication with the controller through the serial data output channel.

* * * * *